US006672594B2

(12) United States Patent
Kozerski

(10) Patent No.: US 6,672,594 B2
(45) Date of Patent: Jan. 6, 2004

(54) HIGH TEMPERATURE COATING OF EXHAUST COMPONENTS

(75) Inventor: Richard J. Kozerski, Lisle, IL (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/862,650

(22) Filed: May 21, 2001

(65) Prior Publication Data

US 2002/0171206 A1 Nov. 21, 2002

(51) Int. Cl.[7] ..... F16J 15/08

(52) U.S. Cl. ..... 277/627; 277/500; 277/591; 277/608; 285/55

(58) Field of Search ..... 285/55, 334.5, 285/49; 277/314, 500, 591, 592, 608, 627

(56) References Cited

U.S. PATENT DOCUMENTS 3,179,449 A 4/1965 Markisen
3,819,208 A 6/1974 Janle
3,843,764 A 10/1974 Grawey et al.
3,930,071 A * 12/1975 Rao et al. ..... 427/203
4,471,968 A 9/1984 Schlaupitz et al.
4,630,849 A * 12/1986 Fakui et al. ..... 285/55
4,871,181 A 10/1989 Usher et al.
5,212,227 A * 5/1993 Sakazume et al. ..... 524/504
5,462,291 A * 10/1995 Maeda et al. ..... 277/507
5,743,011 A 4/1998 Dickerson et al.
6,352,264 B1 * 3/2002 Datzell ..... 277/415

* cited by examiner

*Primary Examiner*—Anthony Knight
*Assistant Examiner*—E Peavey
(74) *Attorney, Agent, or Firm*—Rader, Fishman & Grauer PLLC

(57) ABSTRACT

A coating used to seal together surfaces of components is disclosed. The coating reduces costs associated with using gaskets and fine machining of metal components, and has slip characteristics that allow sealed components to move without eroding the coating. The coating is particularly useful in high temperature environments such as the exhaust systems of motor vehicles. Methods of using coatings to seal components are also disclosed.

18 Claims, 2 Drawing Sheets

HIGH TEMPERATURE COATING OF EXHAUST COMPONENTS

FIELD OF THE INVENTION

The present invention relates to coatings used in joints of an exhaust system of internal combustion engines, and more particularly to a seal between an exhaust manifold outlet and an exhaust pipe inlet.

BACKGROUND OF THE INVENTION

Contact surfaces of parts needing a sealed joint traditionally rely on gaskets because direct contact of the surfaces does not adequately seal the joint without expensive, fine machining of the surfaces. Gaskets, which generally comprise one or more layers of a malleable material, are employed to prevent the escape or leakage of gas between two contact surfaces that are bolted together. This task can be difficult to accomplish in high-temperature, high-pressure environments, such as that of an internal combustion engine. Known applications include the placement of a gasket, usually metallic, between the exhaust manifold and an exhaust pipe. The gasket is intended to provide an exhaust seal at the interface between the manifold and pipe that prevents combustion byproducts from escaping into the engine compartment of a vehicle.

Gaskets, however, have several drawbacks. Because of the high temperature, high pressure environment of the manifold/pipe interface, gaskets used in such environments are often made of specialized and expensive materials. Furthermore, the proper assembly of the manifold/pipe interface with a gasket can be labor intensive and time consuming, because even a small deviation from optimal placement can lead to a leaky seal. The operational environments of gaskets contribute to the inability of gasket to maintain a proper seal. Engine vibration tends to cause the gaskets to move, while high temperatures tend to degrade the gasket. Furthermore, even with gaskets, the contact surfaces of the manifold and pipe need to be finely machined.

Maintaining the seal at the manifold/pipe interface is important because leakage allows combustion byproducts into the engine compartment of a vehicle. This misdirection of exhaust gases prevents their proper conditioning before exhausting to the atmosphere. In addition, the leakage also increases engine noise, just as any hole in the exhaust system upstream of the muffler would also increase engine noise.

Thus, there exists a need for an efficient, recyclable, and economical improved seal between the exhaust manifold and the exhaust pipe.

SUMMARY OF THE INVENTION

The present invention provides a seal for use in a vehicle engine, which includes a first component that resists decomposition at the operating temperature of the vehicle engine and has a low coefficient of friction, and a second component that augments the sealing properties of the first component.

Another aspect of the present invention provides an exhaust system of a vehicle engine, which includes an exhaust manifold having a sealing surface, an exhaust pipe also having a sealing surface and a coating disposed between the sealing surfaces of the exhaust manifold and the exhaust pipe. The coating includes a first component that resists decomposition at the operating temperature of the vehicle engine and has a low coefficient of friction, and a second component that augments sealing properties of the first component.

A third aspect of the present invention provides a method of sealing an interface between an exhaust manifold and an exhaust pipe. The method includes providing an exhaust manifold with an outer sealing surface and an exhaust pipe with an inner sealing surface, applying a coating to the outer sealing surface or to the inner sealing surface or to both surfaces, and contacting the inner and outer sealing surfaces. The coating includes a first component that resists decomposition at the operating temperature of the vehicle engine and has a low coefficient of friction, and a second component that augments the sealing properties of the first component.

Seal coatings offer certain advantages over conventional sealing techniques. The seal coating obviates the need for gaskets, and minimizes problems associated with their use. Furthermore, the coating will level unevenness in the surface to be sealed, thus allowing the use of surfaces that are not finely machined, while still maintaining a tight sealing connection. Also, the coating has slip characteristics that allow sealed components to move without eroding the coating. The coating of the present invention is particularly useful in high temperature environments such as the exhaust systems of motor vehicles.

DETAILED DESCRIPTION

Figure 1:
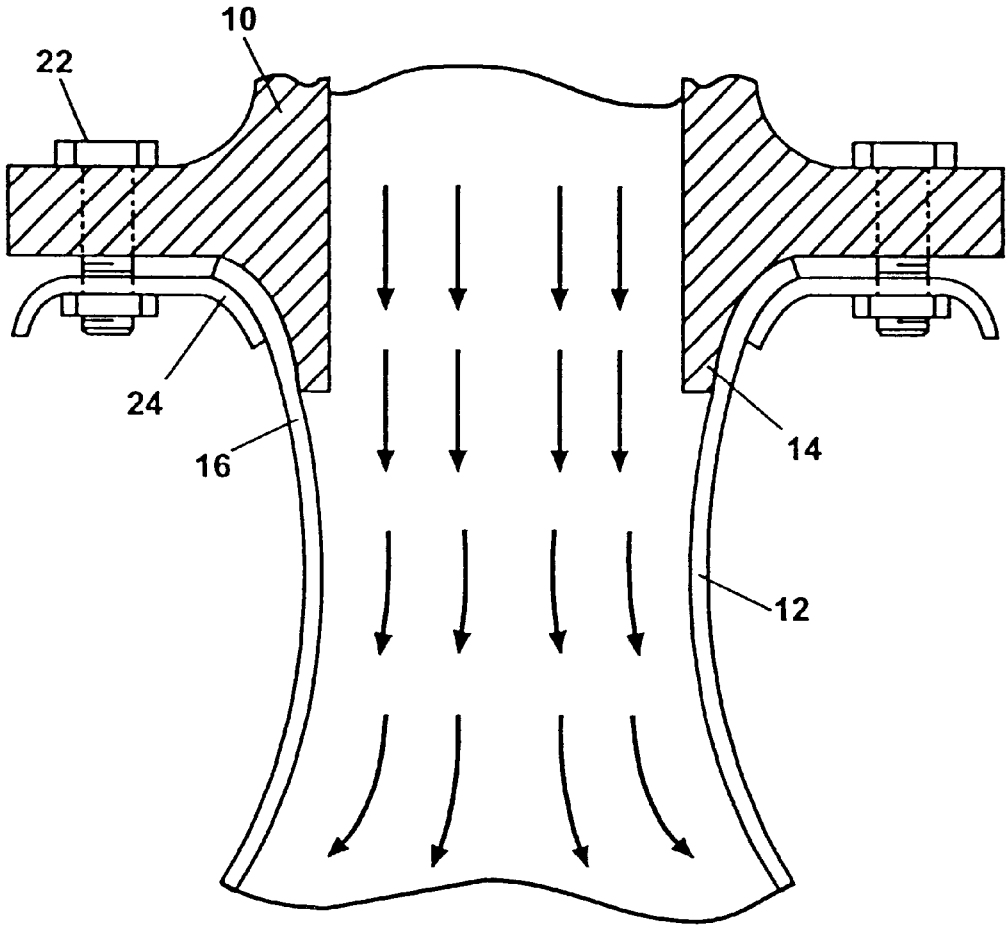
FIG. 1 shows a cross section of an interface between an exhaust manifold and an exhaust pipe.

A cross-section of an interaction of an exhaust manifold 10 and an exhaust pipe 12 is depicted in FIG. 1. In operation, combustion byproducts flow from the exhaust manifold 10 toward the exhaust pipe 12 in the direction indicated by the arrows in FIG. 1. The exhaust manifold 10 includes an outlet 14, while the exhaust pipe includes an inlet 16. The outlet 14 and the inlet 16 are shaped to be complementary, although perfect agreement of size and shape is not required.

Figure 2:
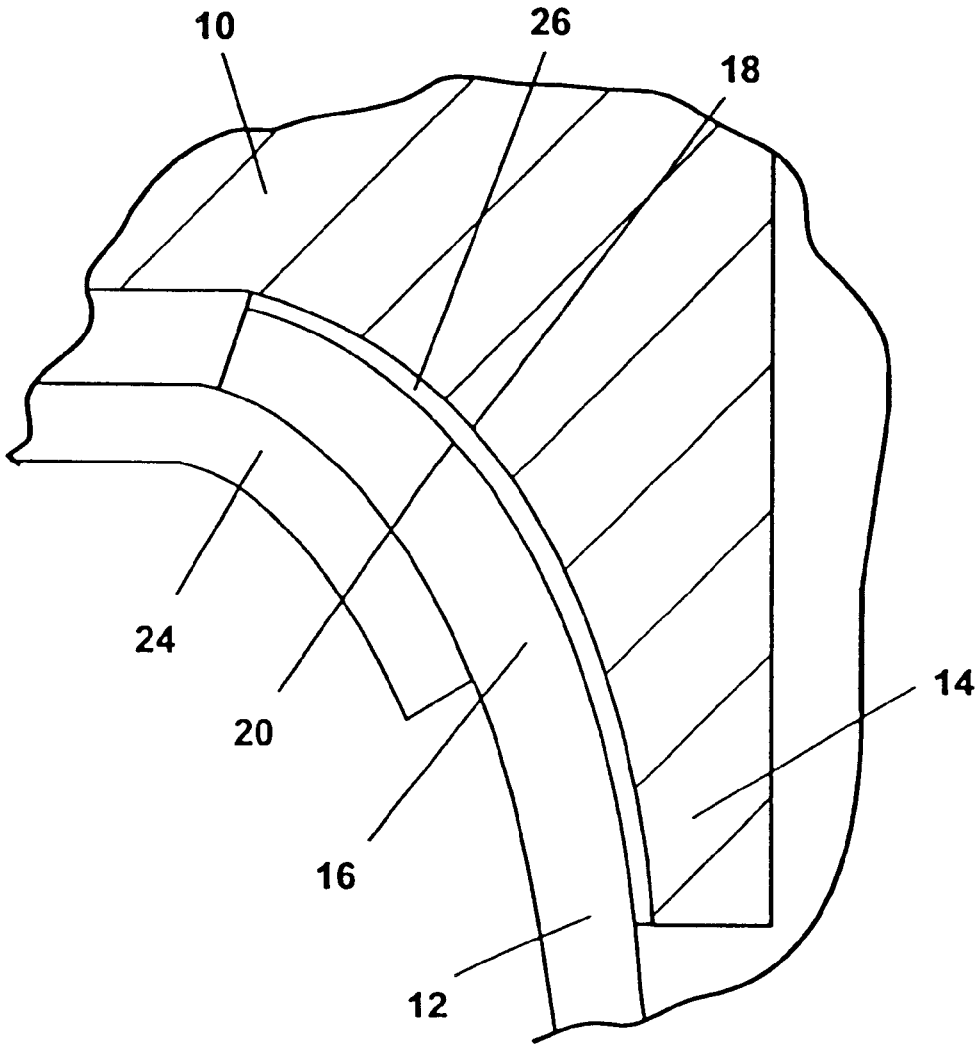
FIG. 2 shows an enlargement of the interface of the exhaust manifold and the exhaust pipe of FIG. 1.

Referring to FIG. 1 and FIG. 2, which shows a close-up cross-sectional view of the interface between the exhaust manifold 10 and the exhaust pipe 12, the outlet 14 includes an outer sealing surface 18, while the inlet 16 includes an inner sealing surface 20. The exhaust manifold 10 is sealingly connected to the exhaust pipe 12 through the use of a fastener 22 and a retaining clip 24. Specifically, the force applied by the retaining clip 24 to the exhaust pipe 12 causes the inner sealing surface 20 to contact the outer sealing surface 18 so as to form a seal.

Traditionally, a gasket has been used to improve the seal between the outer sealing surface 18 and the inner sealing surface 20. However, in the present invention, a coating 26 is applied to ensure proper sealing attachment between the outlet 14 and the inlet 16 without the need for a gasket. As best seen in FIG. 2, the outer sealing surface 18 is separated from the inner sealing surface 20 by the coating 26.

The coating 26 is a chemical layer applied to the outlet 14, the inlet 16 or to the outlet 14 and the inlet 16. The coating 26 improves the seal created by the combination of the fastener 22 and the retaining clip 24. In addition to preventing problems associated with escaping exhaust gases, i.e., noise, the coating 26 also reduces costs associated with fine machining previously required to prevent leakage of exhaust gases. By using the coating 26, the outer sealing surface 18 and the inner sealing surface 20 need not be finely machined to produce a seal. Rather, tolerances can be relaxed because the application of the coating 26 will level any unevenness in the sealing surfaces. Indeed, the cost of the coating 26 can be balanced against the cost of machining, i.e., more coating can be used on a rougher surface, while less coating 26 can be used on a finer surface.

Preferably, the coating 26 is only placed on the actual interface of the outer sealing surface 18 and the inner sealing surface 20 so as to minimize the cost of materials. The coating 26 may either be applied prior to or contemporaneously with the assembly of the manifold/pipe interaction. The coating 26 may be applied in any convenient manner, however, spraying is particularly useful because of the ease of application.

The coating 26 may be any applied layer which improves the seal between the outer sealing surface 18 and the inner sealing surface 20. The coating 26 generally has two components. A first component includes a composition which is heat resistance, but also has a low coefficient of friction. The heat resistance prevents the decomposition of the coating at the operating temperatures of the engine. The low coefficient of friction allows the sealed parts to slip slightly. This helps prevent the coating from being worn away by the movements inherent in a running engine. Typically, the first component resists temperatures between about 500° C. and about 1200° C. and has a coefficient of friction between about 0.05 and about 0.4. More typically, the first component resists temperatures between about 800° C. and about 1000° C. and has a coefficient of friction between about 0.1 and about 0.3. A useful first component is a silicone elastomer containing boron nitride.

The second component of the coating 26 is designed to augment the sealing properties of the coating. The second component may be applied with the first component or as a separate layer from the first component. A useful second component includes polyethylene wax.

While the coating described in connection with the manifold/pipe interface, it may be used in any situation where a gasket is currently being utilized such as other portions of the exhaust system, engine, or vehicle. Indeed, the coating can be used to seal the interface between two or more surfaces.

While the invention has been specifically described in connection with certain specific embodiments, it is to be understood that this is by way of illustration and not of limitation, and the scope of the appended claims should be construed as broadly as the prior art will permit.

What is claimed is:

1. A seal for use in an internal combustion engine, comprising:

a coating having a first component that resists decomposition at the operating temperature of the vehicle engine, the first component having a low coefficient of friction; and a second component of polyethylene wax that augments the sealing properties of the first component.

2. The seal of claim 1, wherein the first component of the coating resists decomposition at temperatures between about 800° C. and about 1000° C.

3. The seal of claim 1, wherein the first component of the coating has a coefficient of friction between about 0.1 and about 0.3.

4. The seal of claim 1, wherein the second component of the coating is applied as a separate layer from the first component.

5. An exhaust system of an internal combustion engine comprising:

an exhaust manifold having a sealing surface;

an exhaust pipe having a sealing surface; and a coating disposed between the sealing surfaces of the exhaust manifold and the exhaust pipe, the coating comprising a first component that resists decomposition at the operating temperature of the vehicle engine and has a low coefficient of friction, and a second component of polyethylene wax that augments sealing properties of the first component.

6. The exhaust system of claim 5, wherein the first component of the coating resists decomposition at temperatures between about 800° C. and about 1000° C.

7. The exhaust system of claim 5, wherein the first component of the coating has a coefficient of friction between about 0.1 and about 0.3.

8. The exhaust system of claim 5, wherein the second component of the coating is a separate layer from the first component.

9. A method of sealing an interface between an exhaust manifold and an exhaust pipe, the method comprising:

providing an exhaust manifold with an outer sealing surface and an exhaust pipe with an inner sealing surface;

applying a coating to at least one of the outer sealing surface or the inner sealing surface; and contacting the exhaust manifold and the exhaust pipe such that the outer sealing surface sealingly contacts the inner sealing surface;

wherein the coating includes a first component that resists decomposition at the operating temperature of the vehicle engine and has a low coefficient of friction, and a second component of polyethylene wax that augments the sealing properties of the first component.

10. The method of claim 9, wherein the first component of the coating resists decomposition at temperatures between about 800° C. and about 1000° C.

11. The method of claim 9, wherein the first component of the coating has a coefficient of friction between about 0.1 and about 0.3.

12. The method of claim 9, wherein the second component of the coating is a separate layer from the first component.

13. A seal for use in an internal combustion engine, comprising:

a coating having a first component including boron nitride and a silicone elastomer; and a second component that augments the sealing properties of the first component.

14. The seal of claim 13, wherein the second component of the coating includes a polyethylene wax.

15. An exhaust system of an internal combustion engine comprising:

an exhaust manifold having a sealing surface;

an exhaust pipe having a sealing surface; and a coating disposed between the sealing surfaces of the exhaust manifold and the exhaust pipe, the coating comprising a first component including boron nitride and a silicone elastomer, and a second component that augments sealing properties of the first component.

16. A method of sealing an interface between an exhaust manifold and an exhaust pipe, the method comprising:

providing an exhaust manifold with an outer sealing surface and an exhaust pipe with an inner sealing surface;

applying a coating to at least one of the outer sealing surface or the inner sealing surface; and contacting the exhaust manifold and the exhaust pipe such that the outer sealing surface sealingly contacts the inner sealing surface;

wherein the coating includes a first component including boron nitride and a silicone elastomer, and a second component that augments the sealing properties of the first component.

17. The exhaust system of claim 15, wherein the second component of the coating includes a polyethylene wax.

18. The method of claim 16, wherein the second component of the coating includes a polyethylene wax.

* * * * *